US008427056B2

(12) United States Patent
Utsubo et al.

(10) Patent No.: US 8,427,056 B2
(45) Date of Patent: Apr. 23, 2013

(54) HIGH-INTENSITY DISCHARGE LAMP

(75) Inventors: Atsushi Utsubo, Osaka (JP); Shunsuke Kakisaka, Osaka (JP); Akio Takubo, Osaka (JP); Masahito Yoshida, Osaka (JP); Yukiya Kanazawa, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/390,074

(22) PCT Filed: Jan. 12, 2011

(86) PCT No.: PCT/JP2011/000106

§ 371 (c)(1),
(2), (4) Date: Feb. 10, 2012

(87) PCT Pub. No.: WO2011/108176

PCT Pub. Date: Sep. 9, 2011

(65) Prior Publication Data

US 2012/0146498 A1 Jun. 14, 2012

(30) Foreign Application Priority Data

Mar. 3, 2010 (JP) ..... 2010-046797

(51) Int. Cl.
*H01J 61/54* (2006.01)

(52) U.S. Cl.
USPC ..... 313/631; 313/570; 313/607; 313/594; 313/292

(58) Field of Classification Search ..... None
See application file for complete search history.

(56) References Cited

U.S. PATENT DOCUMENTS

| | | | | |
|---|---|---|---|---|
| 6,198,223 | B1 | 3/2001 | Scholz | |
| 6,563,267 | B1 | 5/2003 | Van Den Nieuwenhuizen et al. | |
| 7,164,226 | B2 * | 1/2007 | Kai et al. | 313/284 |
| 2006/0226754 | A1 * | 10/2006 | Arndt et al. | 313/318.09 |
| 2011/0062867 | A1 * | 3/2011 | Kakisaka | 313/634 |

FOREIGN PATENT DOCUMENTS

| | | |
|---|---|---|
| JP | 2000-030663 | 1/2000 |
| JP | 2001-167737 | 6/2001 |
| JP | 2001-283781 | 10/2001 |
| JP | 2001-345075 | 12/2001 |
| JP | 2001-345076 | 12/2001 |
| JP | 2002-175780 | 6/2002 |
| JP | 2003-526182 | 9/2003 |
| JP | 2004-193061 | 7/2004 |
| JP | 2005-347060 | 12/2005 |
| JP | 2007-073436 | 3/2007 |

* cited by examiner

*Primary Examiner* — Ashok Patel

(57) ABSTRACT

A lamp having: an arc tube (30) including a main tube portion and a pair of thin tube portions (46) provided at ends of the main tube portion; and an adjacent conductor (78) including a strip-shaped metal plate. In the adjacent conductor (78), a portion of the metal plate in the direction of length thereof, from the middle of the metal plate to just before an edge thereof, is a gripping portion (92) having a shape suitable for gripping the outer circumferential of one of the thin tube portions (46). One end of the gripping portion (92) is a free end. The gripping portion (92) is disposed along an outer circumferential surface of the thin tube portion (46) so as to be in contact with the outer circumferential surface, and is elastically deformable in accordance with expansion in the radial direction of the thin tube portion (46).

20 Claims, 14 Drawing Sheets

| | Thickness [mm] | | | | | | | |
|---|---|---|---|---|---|---|---|---|
| | 0.05 | | 0.1 | | 0.3 | | 0.5 | |
| Circular arc angle [degree] | Attachment | Contact | Attachment | Contact | Attachment | Contact | Attachment | Contact |
| 190 | ○ | ○ | ○ | ○ | ○ | ○ | ○ | ○ |
| 225 | ○ | ○ | ○ | ○ | ○ | ○ | × | – |
| 240 | ○ | ○ | ○ | ○ | ○ | ○ | × | – |
| 270 | ○ | × | ○ | ○ | ○ | ○ | × | – |
| 300 | ○ | × | ○ | ○ | ○ | ○ | × | – |
| 315 | ○ | × | ○ | × | × | – | × | – |
| 360 | ○ | × | × | – | × | – | × | – |

FIG. 10

| | Width of adjacent conductor [mm] | | |
|---|---|---|---|
| L3[mm] | 1 | 2 | 3 |
| -3 | × | × | × |
| -2 | × | × | ○ |
| -1 | × | ○ | ○ |
| 0 | ○ | ○ | ○ |
| 1 | ○ | ○ | ○ |
| 2 | △ | △ | △ |
| 3 | △ | △ | △ |

HIGH-INTENSITY DISCHARGE LAMP

TECHNICAL FIELD

The present invention relates to improvement in starting performance of high-intensity discharge lamps.

BACKGROUND ART

Technologies for improving starting performance of high-intensity discharge lamps, such as high-pressure mercury-vapor lamps and metal-vapor discharge lamps, are disclosed in Patent Literatures 1-8, for example. Patent Literature 1 discloses enclosing a substance for improving the starting performance in the arc tube, and Patent Literatures 2-8 disclose providing the arc tube with an adjacent conductor.

As an adjacent conductor, Patent Literatures 2-6 disclose the use of a metal wire. Patent Literature 7 discloses the use of a conductive film. Patent Literature 8 discloses the use of a metal plate.

Patent Literatures 2-6, which use a wire, disclose a technology of winding a wire around a thin tube portion of the arc tube so as to form a coil (i.e. winding a plurality of times), a technology of winding a wire around the entire circumference of the thin tube portion once, and a technology of winding a wire around ¾ or ⅝ of the circumference.

Patent Literature 7, which uses a conductive film, discloses a technology of forming the conductive film on the thin tube portion of the arc tube, and connecting the conductive film and a power supply line with a metal wire.

Patent Literature 8, which uses a metal plate, discloses a technology of folding a strip of metal plate in the middle, forming concavities (i.e. curved portions) in the end portions of the metal plate which face each other due to the folding in conformity with the shape of the thin tube portion of the arc tube, and welding the facing end portions of the metal plate to each other with the thin tube portion sandwiched between the concavities.

CITATION LIST

Patent Literature

[Patent Literature 1]
Japanese Patent Application Publication No. 2005-347060
[Patent Literature 2]
Japanese Patent Application Publication No. 2000-30663
[Patent Literature 3]
Japanese Patent Publication No. 4135050
[Patent Literature 4]
Japanese Patent Application Publication No. 2001-345075
[Patent Literature 5]
Japanese Patent Application Publication No. 2002-175780
[Patent Literature 6]
Japanese Patent Application Publication No. 2007-73436
[Patent Literature 7]
Japanese Patent Application Publication No. 2001-345076
[Patent Literature 8]
Japanese Patent Application Publication No. 2001-283781

SUMMARY OF INVENTION

Technical Problem

Practical use of the technologies described above, however, has the following problems.

Although the technology disclosed in Patent Literature 1 improves the starting performance, it has an environmental problem, because it uses krypton 85 (i.e. Kr 85), for example.

With the technologies disclosed in Patent Literatures 2-6, contact between the power supply line and the thin tube portion is line contact, and thus the starting performance (i.e. starting voltage) is not stable. In addition, in the case where the wire is shaped into a coil, the starting voltage is not stable due to variations in coil pitch. This is problematic.

With the technology disclosed in Patent Literature 7, a contact area is stably secured between the power supply line and the thin tube portion, and thus the starting voltage is stable, which achieves preferable starting performance. However, difficulties arise in connecting the conductive film with the power supply line by the metal wire, and there are possibilities that the conductive film and the power supply line are disconnected in transportation.

With the technology disclosed in Patent Literature 8, a contact area is stably secured between the power supply line and the thin tube portion because of the use of the metal plate, which achieves preferable starting performance. However, since the facing end portions are to be welded to each other with the thin tube portion sandwiched therebetween, the welding is troublesome and its cost is high. In addition, there are problems that the weld between the facing end portions breaks due to thermal expansion of the thin tube portion during lighting, or cracks are made in the thin tube portion due to the stress caused by the fastened metal plate.

The present invention aims to provide a high-intensity discharge lamp that can be manufactured through simple processes and stably achieves preferable starting performance without using a material for improving the starting performance.

Solution to Problem

To achieve the aim, the present invention provides a high-intensity discharge lamp comprising: an arc tube including a main tube portion and a pair of thin tube portions provided at ends of the main tube portion; and an adjacent conductor aiding the arc tube to start discharge, wherein the adjacent conductor includes a strip-shaped metal plate, at least one end portion of the metal plate is a gripping portion for gripping one of the thin tube portions, the gripping portion being curved along an outer circumferential surface of the one of the thin tube portions so as to be in contact with the outer circumferential surface, and one end of the metal plate is a free end, and the gripping portion is elastically deformable in accordance with thermal expansion of the one of the thin tube portions.

The "high-intensity discharge lamp" mentioned above is a concept including a high-pressure discharge lamp and a metal-vapor discharge lamp. The phrase "elastically deformable in accordance with thermal expansion of the one of the thin tube portions" means that the gripping portion is configured to be elastically deformable in consideration of parameters such as the thickness and the material of the metal plate, the outer diameter of the thin tube portion, and the shape (stiffness) of the gripping portion. The phrase "thermal expansion of the one of the thin tube portions" means that the thin tube portion expands or the outer perimeter of the thin tube portion increases (in length) due to thermal expansion when the lamp is lit (including the start of the lighting and the period during the lighting).

The adjacent conductor only needs to include a metal plate. In adjacent conductor, the other end of the metal plate may be directly supported by a supporting member for supporting the adjacent conductor, or be indirectly supported by the supporting member via another member (such as a metal rod). That is, the other end of the metal plate may be fixed to the supporting member, or be fixed to an intermediate member that is fixed to the supporting member.

Advantageous Effects of Invention

In the high-intensity discharge lamp according to the present invention, the gripping portion of the adjacent conductor is disposed along the outer circumferential surface of the thin tube portion so as to be in contact with the outer circumferential surface. Thus, a contact area is stably secured between the gripping portion and the thin tube portion, which leads to stable and preferable starting performance.

Moreover, the gripping portion is elastically deformable in accordance with thermal expansion of the thin tube portion, and one end of the metal plate is a free end. Thus, the gripping portion is elastically deformed according to expansion of the thin tube portion due to heat when the lamp is lit. Thus, even during the lighting, fastening stress on the thin tube portion, which could be a cause of cracks in the thin tube portion, is not caused by the adjacent conductor.

The high-intensity discharge lamp may be characterized in: the one end of the metal plate is angled or curved outward in a radial direction of the one of the thin tube portions; tips of electrodes held by the thin tube portions are located within the main tube portion, and the arc tube is supported by a pair of power supply lines that supply the electrodes with power, and the other end of the metal plate of the adjacent conductor is fixed to one of the power supply lines that supplies one of the electrodes held by the other one of the thin tube portions; and the one of the power supply lines is provided along a tube axis direction of the arc tube, and a section thereof is angled or curved outward in a direction perpendicular to the tube axis direction so as to form a protrusion, the protrusion corresponding in location to the main tube portion, and the other end of the metal plate of the adjacent conductor is fixed at least to the section.

The high-intensity discharge lamp may also be characterized in: the one of the thin tube portions has a cylindrical shape, and a cross-section of the gripping portion has a C shape with a curvature in a range from a value that is 3% smaller than a curvature of the outer circumferential surface of the one of the thin tube portions to a value that is the same as the curvature of the outer circumferential surface of the one of the thin tube portions; the gripping portion wraps around no less than 190° nor more than 300° of the one of the thin tube portions with respect to a tube axis of the one of the thin tube portions; and a thickness of the metal plate is in a range from 0.1 mm to 0.3 mm.

BRIEF DESCRIPTION OF DRAWINGS

FIG. 10 shows variations of the starting performance in relation to combinations of the location and width of the adjacent conductor.

DESCRIPTION OF EMBODIMENT

The following describes a metal halide lamp according to an embodiment of the present invention with reference to the drawings.

1. Structure (1) Lighting Apparatus

First, an example of a lighting apparatus provided with a metal halide lamp according to the Embodiment is described (Hereinafter, such a metal halide lamp may be simply referred to as "a lamp").

Figure 1:
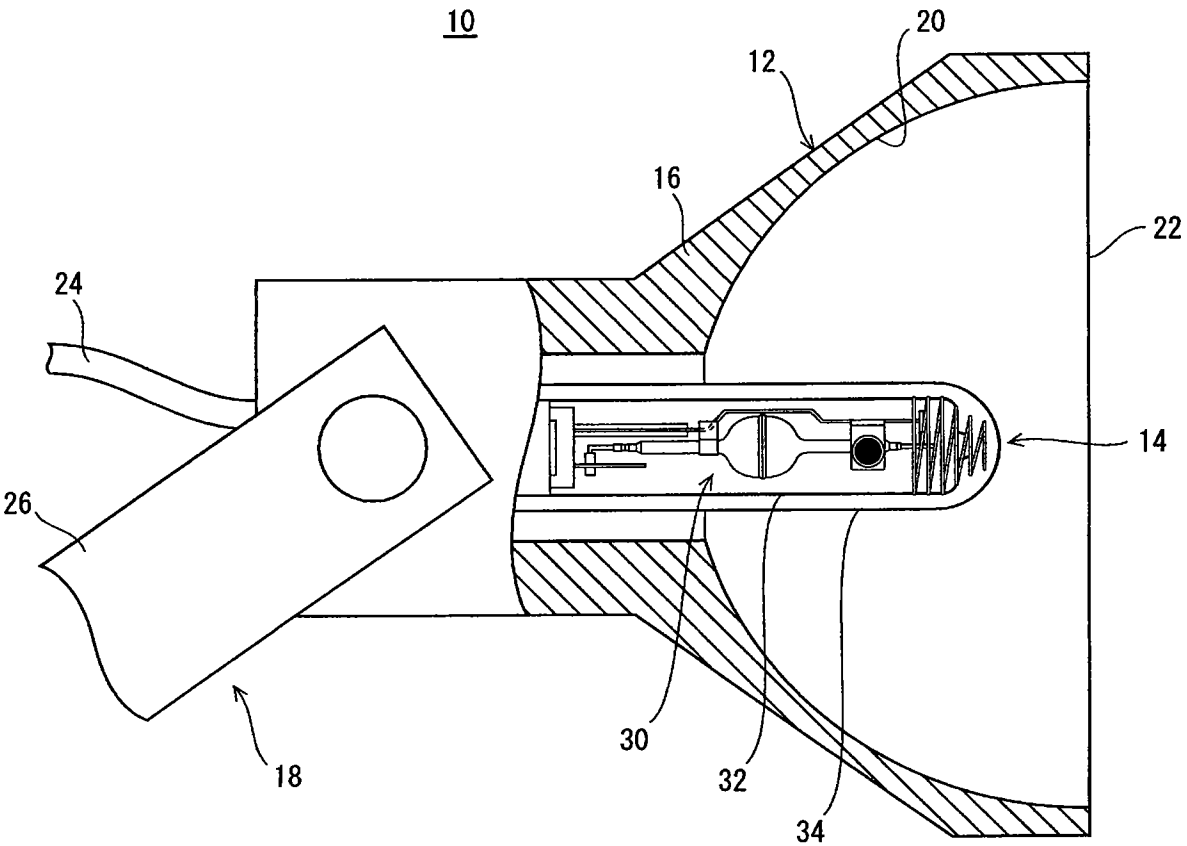
FIG. 1 is an overall diagram of a lighting apparatus provided with a metal halide lamp according to the Embodiment, with a portion of the lighting apparatus omitted so as to illustrate the inside of a reflector.

FIG. 1 is an overall diagram of a lighting apparatus 10 provided with a metal halide lamp according to the Embodiment, with a portion of the lighting apparatus omitted so as to illustrate the inside of the lighting fixture 12.

As shown in FIG. 1, the lighting apparatus 10 includes a lighting fixture 12 and a lamp 14 housed in the lighting fixture 12. Note that the lighting fixture 12 is a spotlight, but the metal halide lamp according to the Embodiment may be housed and used in other lighting fixtures, such as base lights The lighting fixture 12 is provided with a reflector 16, a socket (omitted from the drawings), and an attachment unit 18. The reflector 16 reflects light emitted by the lamp 14, which is housed inside the lighting fixture 12, forwards. The socket is incorporated into the reflector 16, and the lamp 14 is attached to the socket. The attachment unit 18 is for attaching the reflector 16 to a wall or ceiling.

As shown in the figures, the reflector 16 is provided with a concave reflecting surface 20. This reflecting surface 20 is formed with an aluminum mirror, for example. Note that the opening 22 of the reflector 16 (where light exits) is not covered by a glass plate or the like. In other words, the reflector 16 is a (front end) open type.

The socket is electrically connected to the lamp 14 and provides power to the lamp 14. Note that a ballast (omitted from the drawings) for lighting the lamp 14 is embedded in the ceiling (or behind the ceiling), for example, and provides electric power to the lamp 14 via a feed wire 24.

The attachment unit 18 is a U-shaped section, for example, having a pair of parallel arms 26 and a junction (omitted from the drawings) joining an end of each of the arms 26. The reflector 16 is sandwiched between the arms 26 so as to be supported by the arms 26 to rotate freely. The junction is attached to the wall or ceiling, for example. Note that the direction of light emitted from the lighting apparatus 10 can be adjusted by rotating the rotatable attachment unit 18 which is freely rotatable with respect to the reflector 16.

(2) Lamp

Figure 2:
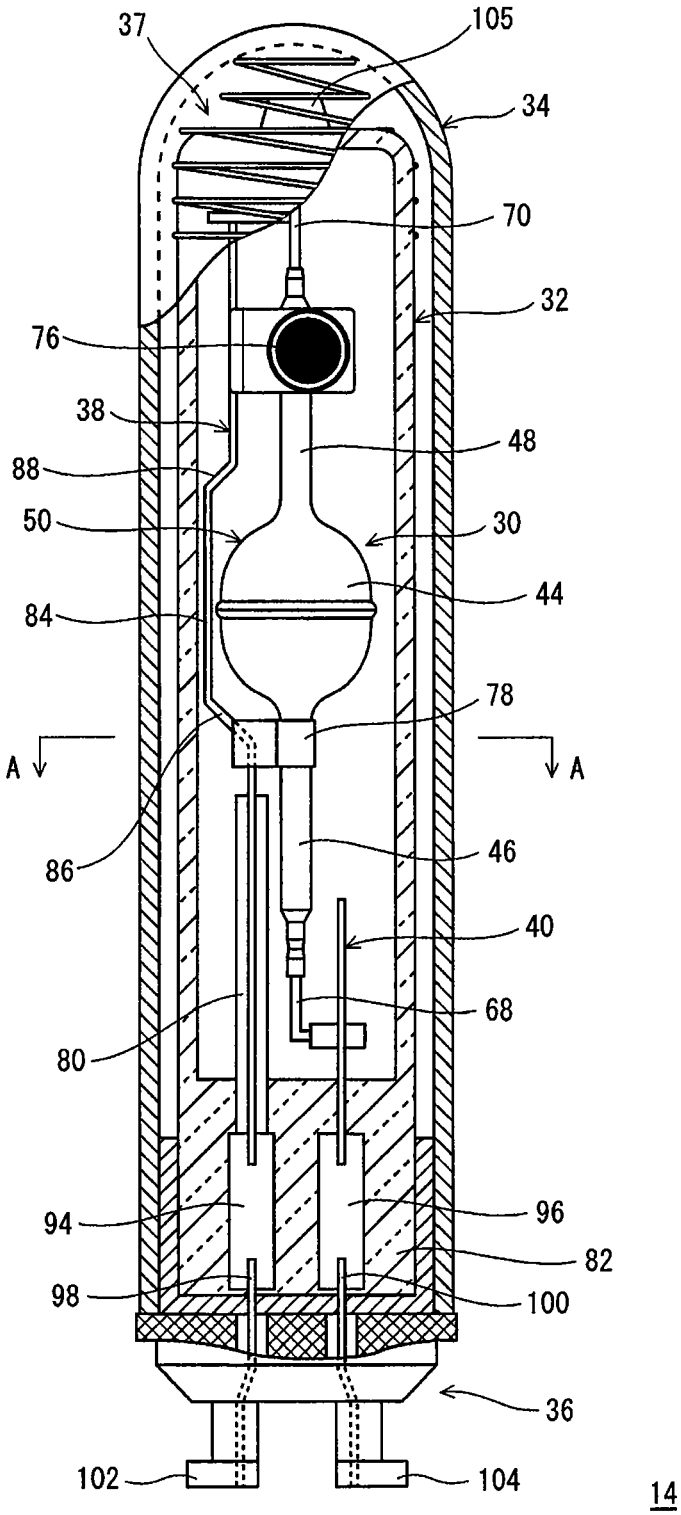
FIG. 2 is a front view of the lamp according to the Embodiment.

FIG. 2 is a front view of the lamp 14 according to the Embodiment.

The lamp 14 has a triple tube structure provided with an arc tube 30, an inner tube 32, and an outer tube 34. The arc tube 30 encloses a pair of electrodes and forms a discharge space. The inner tube 32 is an airtight container housing the arc tube 30. The outer tube 34 is a protective container enclosing the inner tube 32. The lamp 14 further includes a base 36 for receiving power from the socket of the lighting fixture 12, a positioning member 37 for preventing the inner tube 32 from shifting with respect to the outer tube 34, a pair of power supply lines 38 and 40 for supplying power to the arc tube 30 and for supporting the arc tube 30, and the like.

Figure 3:
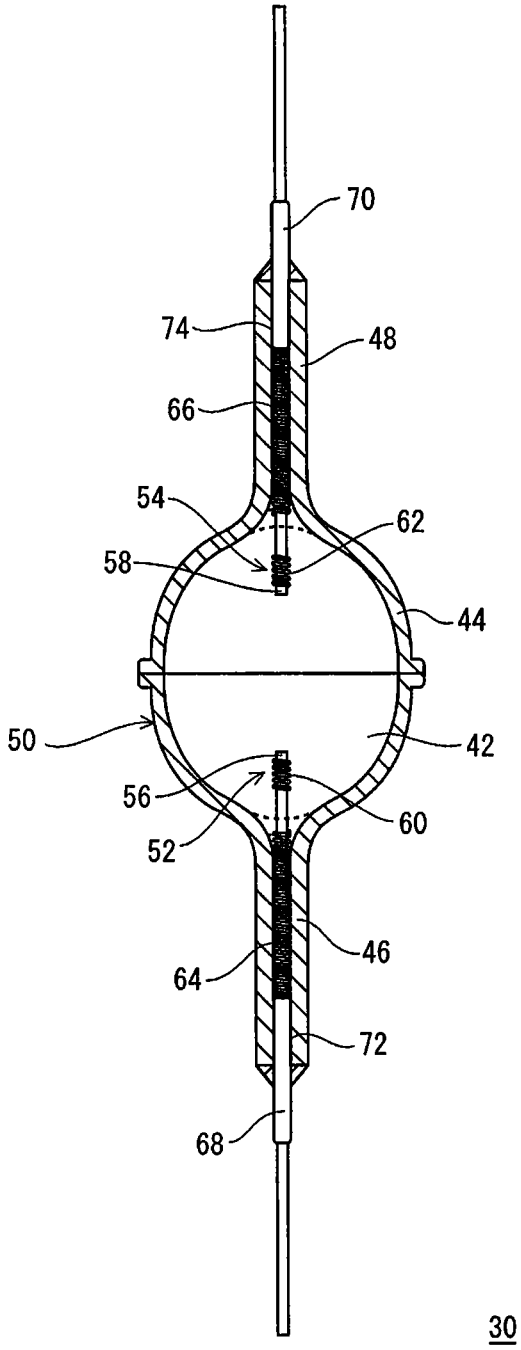
FIG. 3 is a front cross-section diagram of an arc tube.

FIG. 3 is a front cross-section diagram of the arc tube 30.

The arc tube 30 has an envelope 50 composed of a main tube portion 44, which has a discharge space 42 hermetically sealed therein, and thin tube portions 46 and 48 formed to extend respectively from either side of the main tube portion 44 in the direction of the tube axis.

The main tube portion 44 and the thin tube portions 46 and 48 are formed from translucent ceramic, for example. The arc tube 30 is referred to as a ceramic arc tube, for example. Polycrystalline alumina ceramic may, for example, be used as the translucent ceramic. Note that another type of ceramic, or quartz glass or the like, may be used.

A pair of electrodes 52 and 54 that face each other along a central axis in the direction of length of the lamp 14 (hereinafter also referred to simply as the "lamp axis"), or along an axis parallel to the lamp axis, are provided in the discharge space 42 of the main tube portion 44.

The discharge space 42 encloses a luminescent material, a starting gas, and a buffer gas. In conventional metal vapor discharge lamps, for example, a predetermined amount of each of a metal halide, which is a luminescent material, a rare gas, which is a starting gas, and mercury, which is a buffer gas, is enclosed. Examples of the metal halide include sodium iodide, dysprosium iodide, and a mixed iodide containing cerium iodide. Note that the metal halide is determined to correspond appropriately with the light source color of the lamp 14.

As shown in FIG. 3, the electrodes 52 and 54 include electrode bars 56 and 58 and electrode coils 60 and 62 provided at respective tips of the electrode bars 56 and 58 (the tips in the discharge space 42). Molybdenum coils 64 and 66 are wrapped around the electrode bars 56 and 58 to prevent the luminescent material from entering a gap between the electrode bars 56 and 58 and the thin tube portions 46 and 48.

Ideally (by design) the electrodes 52 and 54 face each other along the lamp axis, as described above. In other words, the electrodes 52 and 54 are positioned so that the lamp axis and the central axis of the electrode bars 56 and 58 coincide along a straight line. In practice, however, depending on the accuracy of the manufacturing process, the central axis and the lamp axis may not coincide in some cases.

The thin tube portions 46 and 48 are cylindrical. Power suppliers 68 and 70, to which the electrodes 52 and 54 are attached, are inserted in respective other tips of the thin tube portions 46 and 48 (the other tips being opposite the main tube portion 44). The power suppliers 68 and 70 are sealed and fixed by sealing material 72 and 74 composed of frit that is poured into the tips of the thin tube portions 46 and 48.

The description now returns to the lamp 14.

As shown in FIG. 2, the inner tube 32 is a tube having a bottom. The inner tube 32 houses, in addition to the arc tube 30, the pair of power supply lines 38 and 40 that are roughly parallel to the direction in which the axis of the arc tube 30 extends, a getter 76 for absorbing impurities in the inner tube 32, an adjacent conductor 78 for improving starting performance of the arc tube 30, a fused quartz glass tube 80 covering part of the power supply line 38, and the like. The opening of the inner tube 32 is sealed by pinch sealing. Note that the portion sealed by pinch sealing is referred to as a sealed portion 82, and the inner tube 32 is hermetically sealed by the sealed portion 82.

The pair of power supply lines 38 and 40 are for supplying power to the arc tube 30, as described above, and are supported by the sealed portion 82 of the inner tube 32.

The power supply lines 38 and 40 have different lengths. The longer power supply line 38 extends along an outer surface of the arc tube 30, and at the main tube portion 44 of the arc tube 30, the power supply line 38 protrudes towards the outside (in a direction orthogonally away from the tube axis of the arc tube 30). This section that protrudes is designated as a protruding section 84, and the sections that are angled in order to form the protruding section 84 are designated as angled sections 86 and 88. Note that instead of the angled sections 86 and 88 for forming the protruding section 84, a curved section that curves in an arc may be adopted.

The longer power supply line 38 is connected to the power supplier 70 that extends from the thin tube portion 48 of the arc tube 30, and the shorter power supply line 40 is connected to the power supplier 68 that extends from the thin tube portion 46 of the arc tube 30. Note that because of these connections, the arc tube 30 is retained in the inner tube 32.

The getter 76, the adjacent conductor 78, and the fused quartz glass tube 80 are attached to the power supply line 38 in this order starting from the other end of the inner tube 32 (the end opposite the sealed portion 82).

The getter 76 is fixed to the power supply line 38 so as to straddle both the thin tube portion 48 of the arc tube 30 and the power supply line 38 extending in parallel with the thin tube portion 48. Note that the thin tube portion 48 is located farther away from the sealed portion 82 of the inner tube 32, i.e. near the other end of the inner tube 32. The getter 76 is fixed by welding, for example.

The adjacent conductor 78 is formed from a strip-shaped metal plate. A portion of the metal plate in the direction of length thereof, from the middle of the metal plate to just before an edge thereof, is in contact with the thin tube portion 46, one of the two thin tube portion 46 and 48, by being wrapped (i.e. curved) around the outer circumferential surface thereof. The portion from the middle of the metal plate to just before the edge is designated as a gripping portion (92), which has a shape suitable for gripping the outer circumferential of the thin tube portion 46.

The gripping portion (92) of the adjacent conductor 78 is elastically deformable in accordance with expansion in a radial direction of the thin tube portion 46 and is provided at an end of the metal plate that is a free end allowed to increase in radius as the thin tube portion 46 inflates due to heat when the lamp is lit.

Figure 4:
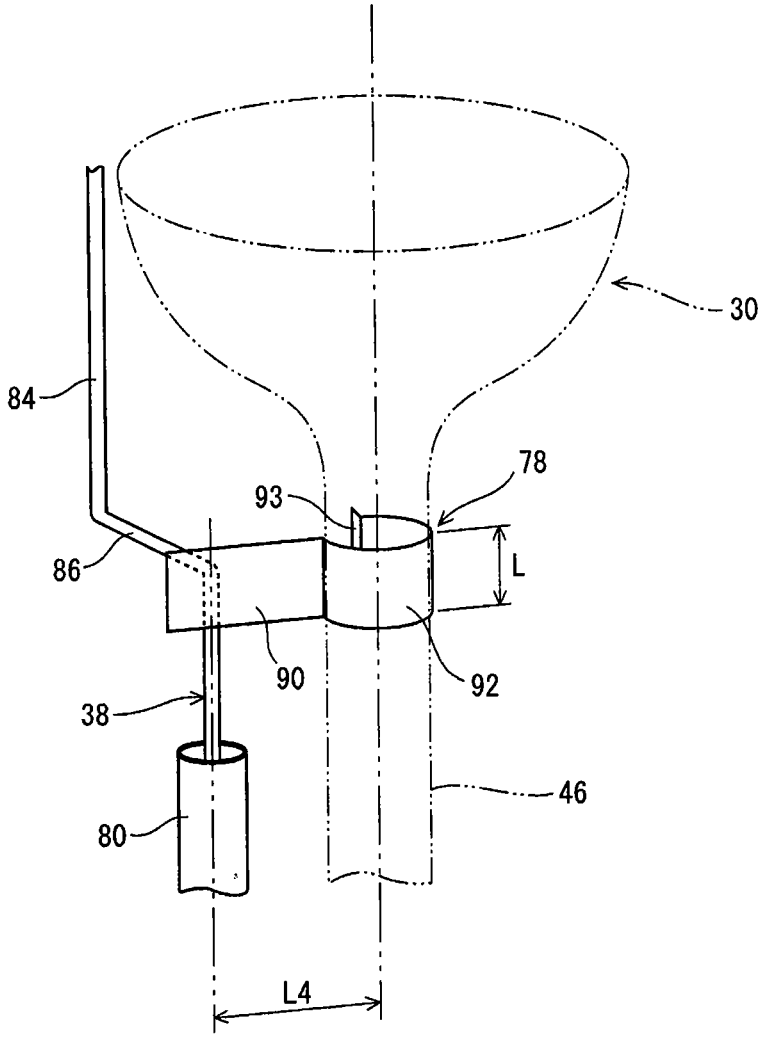
FIG. 4 is a perspective view illustrating an adjacent conductor.

FIG. 4 is a perspective view illustrating the adjacent conductor 78.

The adjacent conductor 78 is formed from a strip-shaped metal plate, and includes a fixed portion 90, the gripping portion 92 described above, and an angled portion 93. The fixed portion 90 is fixed to the power supply line 38. The gripping portion 92 extends from one end of the fixed portion 90 along the outer circumferential surface of the thin tube portion 46, and is in contact with the thin tube portion 46. The angled portion 93 protrudes from one end of the gripping portion 92 towards the outside in the radial direction.

The gripping portion 92 is allowed to increase in radius in accordance with expansion in the radial direction of the thin tube portion 46 when the lamp is lit, being in contact with the outer circumferential surface of the thin tube portion 46 (i.e. the gripping portion 92 is provided along the outer circumferential surface so as to be in contact with the outer circumferential surface, and is elastically deformable in accordance with expansion in the radial direction of the thin tube portion 46).

In other words, the gripping portion 92 extends from one end of the fixed portion 90, wraps (i.e. curves) around the thin tube portion 46 along the outer circumferential surface of the thin tube portion 46, and reaches just before the one end of the fixed portion 90. The other end of the gripping portion 92 (i.e. angled portion 93) is a free end (i.e. one end of the metal plate is a free end).

The curvature of the gripping portion 92 is the same as the curvature of the outer circumferential surface of the cylindrical thin tube portion 46, or is slightly smaller than the curvature of the outer circumferential surface. The curvature of the gripping portion 92 is 3%, for example. Note that the contact angle (i.e. the circular arc angle described below) of the gripping portion 92 in contact with the thin tube portion 46 is preferably in the range from 190° to 300°, when the adjacent conductor 78 is attached to the thin tube portion 46.

The stiffness of the adjacent conductor 78 is such that the adjacent conductor 78 is deformable (elastically deformable) in accordance with expansion in the radial direction of the thin tube portion 46 due to heat when the lamp is lit (Specifically, the metal plate has a thickness with which the adjacent conductor 78 is deformable).

The fixed portion 90 is attached to the power supply line 38 so as to straddle both the straight section and the angled section 86, and is welded in such a state. Hence, the adjacent conductor 78 is fixed to the section where is angled and thus has a higher stiffness than the other section (i.e. the straight section). Consequently, the power supply line 38 is prevented from being bent when the adjacent conductor 78 is attached thereto. Also, in the sealing of the inner tube 32, the distance between the arc tube 30 and the power supply line 38 is kept unchanged.

The power supply line 38 is inserted in the fused quartz glass tube 80 so that the fused quartz glass tube 80 covers the power supply line 38 between the sealed portion 82 and a portion of the power supply line 38 that fixes the adjacent conductor 78.

Returning to FIG. 2, the power supply line 38 and 40 are respectively connected to base pins 102 and 104 of the base 36 via metal foils 94 and 96 and lead wires 98 and 100. Within the sealed portion 82, both ends of the metal foils 94 and 96 are connected (welded) to one ends of the power supply lines 38 and 40 and one ends of the lead wires 98 and 100, and the lead wires 98 and 100 extend out of the sealed portion 82.

A convex portion at the other end of the inner tube 32 is a tip off section 105, which is a remaining portion of an exhaust tube used when vacuum pumping the inner tube 32. Note that a vacuum is created in the inner tube 32 to prevent oxidation of the power suppliers 68 and 70, the power supply lines 38 and 40, and the adjacent conductor 78 which are exposed to a high temperature when the lamp is lit.

As shown in FIG. 2, the inner tube 32 is covered by an outer tube 34 that has a bottom (i.e. a cylinder in which one end is open, and the other end is covered). The method of mounting the inner tube 32 in the outer tube 34 is described below.

The positioning member 37 is for preventing the axis of the inner tube 32 from shifting with respect to the outer tube 34 and is provided between the outer tube 34 and the other end of the inner tube 32. Specifically, the positioning member 37 is a coil formed from a wire, the diameter of which is the distance (gap) between the outer circumferential surface of the other end of the inner tube 32 and the inner circumferential surface of the other end of the outer tube 34. This coil tapers off in conformity with the other end of the inner tube 32.

In addition to serving as a protective tube, the outer tube 34 also serves to absorb a portion of light emitted by the arc tube 30 and passing through the inner tube 32, particularly ultraviolet light that would photochemically affect irradiated substances by causing color degradation, degeneration, and decomposing, for example.

Figure 5:
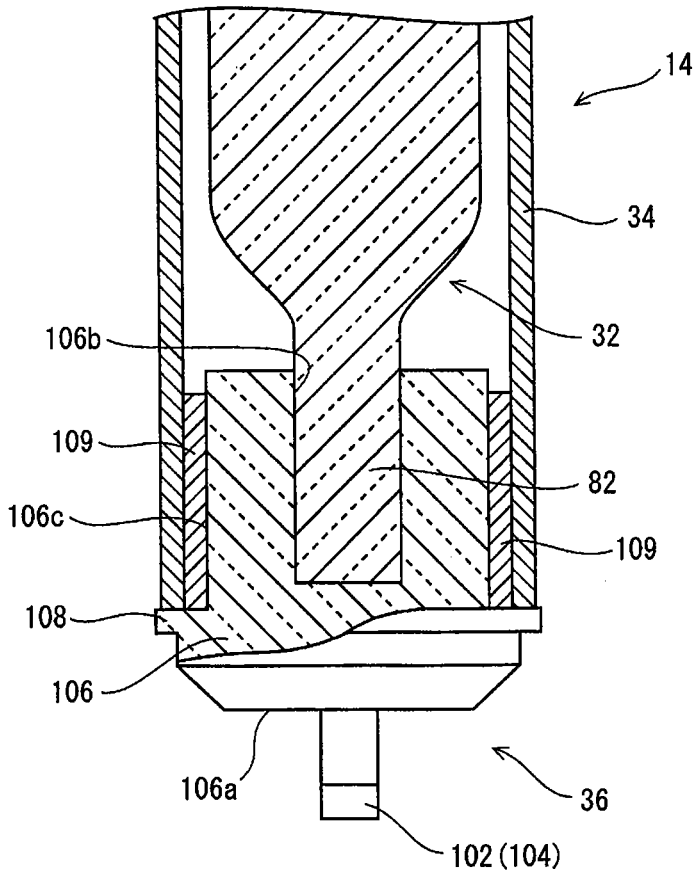
FIG. 5 is a cross-section diagram of one end of the lamp.

FIG. 5 is a cross-section diagram of one end of the lamp.

In FIG. 5, the inner tube 32 is assumed as a single body, and the entire body is indicated by hatching.

The inner tube 32 is inserted into the outer tube 34, being supported by the base 36. The base 36, the inner tube 32, and the outer tube 34 are fixed (integrated) by adhesive 109 (such as cement).

The base 36 includes a cylindrical main body 106, a flange 108, and base pins 102 and 104. The flange 108 is formed along the entire circumference of the main body 106 and protrudes outward from a middle portion of the main body 106, which is substantially in the middle of the main body 106 in the direction of the central axis thereof. The base pins 102 and 104 protrude downward from one edge face **106*a* of the main body 106**.

The main body 106 has a groove **106*b* formed in the other edge face. The groove 106*b* corresponds to the sealed portion 82 of the inner tube 32. The inner tube 32 is housed in the outer tube 34 so that one edge face of the outer tube 34 is in contact with the flange 108 when the sealed portion 82 is inserted in the groove 106*b* (and is fixed by adhesive in some cases). The outer circumferential surface 106*c* of the main body 106 and the inner circumferential surface of the outer tube 34 are joined by the adhesive 109** between them.

2. Attachment of Adjacent Conductor to Thin Tube Portion

The following describes an example method of attaching the adjacent conductor 78 to the thin tube portion 46. The gripping portion 92 of the adjacent conductor 78 is a C-shaped section. The portion corresponding to the opening of the letter "C" is hereinafter simply referred to as "the opening".

First, to fit the thin tube portion 46 into the gripping portion 92, the opening of the adjacent conductor 78 is expanded. This is easy to perform, because it is possible to expand the opening, gripping the angled portion 93. Note that for expansion of the opening, the gripping portion 92 is deformed in the range of elastic deformation.

After the opening is expanded, the thin tube portion 46 is inserted from the expanded opening. The size of the opening of the adjacent conductor 78 is smaller than the outer diameter of the thin tube portion 46. However, the opening expands to the outer diameter of the thin tube portion 46 (i.e. the gripping portion increases in radius) when the thin tube portion 46 is fitted in. This deformation also is performed in the range of elastic deformation.

The attachment of the adjacent conductor 78 to the thin tube portion 46 thus completes. After positioning of the adjacent conductor 78 with respect to the thin tube portion 46, the fixed portion 90 of the adjacent conductor 78 is fixed (welded, for example) to the power supply line 38.

Note that the adjacent conductor 78 may be differently attached to the thin tube portion 46. One alternative is, for example, inserting one end of the thin tube portion 46 into the gripping portion 92, and moving the adjacent conductor 78 to a predetermined position on the thin tube portion 46.

3. Usage State

Figure 6A:
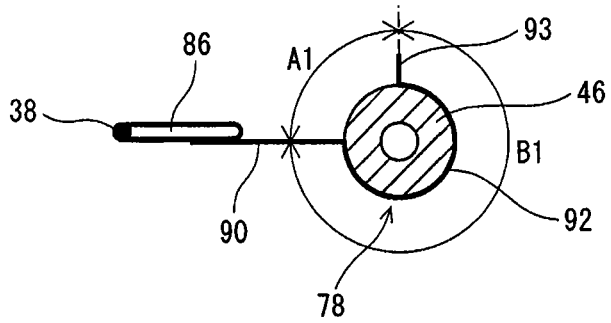
FIGS. 6A and 6B each show cross-section diagrams of the vicinity of the adjacent conductor cut along the imaginary line A-A shown in FIG. 2 and viewed in the direction indicated by the arrows.
Figure 6B:
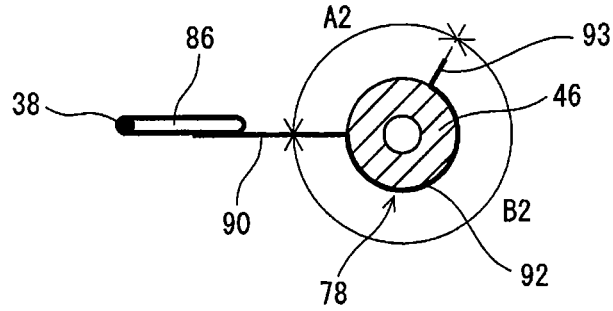

FIGS. 6A and 6B each show cross-section diagrams of the vicinity of the adjacent conductor cut along the imaginary line A-A shown in FIG. 2 and viewed in the direction indicated by the arrows. FIG. 6A shows the state before the lighting, and FIG. 6B shows the state during the lighting. Note that although the thin tube portion inflates in the radial direction thereof in the lighting, such inflation of the thin tube portion is not depicted in FIG. 6B.

While the lamp is in the unlit state, the gripping portion 92 of the adjacent conductor 78 is in contact with the outer circumferential surface of the thin tube portion 46, on the region corresponding to B1 as shown in FIG. 6A. While the lamp is in the lit state, the gripping portion 92 is in contact with the outer circumferential surface of the thin tube portion 46, on the region corresponding to B2 as shown in FIG. 6B.

In other words, while the lamp is in the unlit state, the angle between the fixed portion 90 and the angled portion 93 of the gripping portion 92 is A1 as shown in FIG. 6A. When the thin tube portion 46 expands in the radial direction due to heat when the lamp is lit, the angle between the fixed portion 90 and the angled portion 93 increases to A2.

As described above, since the gripping portion 92 of the adjacent conductor 78 is in contact with a large area on the outer circumferential surface of the thin tube portion 46 while the lamp 14 is in the unlit state, electrical breakdown is readily caused between the adjacent conductor 78 and the electrode 52 when the lamp 14 is started up. This leads to stable starting performance.

The discharge is caused in the arc tube 30, and the lamp enters into its steady lighting state. The temperature of the arc tube 30 in the lit state is higher than in the unlit state, and the arc tube 30 including the thin tube portion 46 expands due to heat (The temperature near the main body 106 of the arc tube 30, entered into the lit state, increases to the degree of from 900° C. to 1000° C., depending on the specifications of the lamp and the posture of the lamp during the lighting).

As described above, the gripping portion 92 of the adjacent conductor 78 slides along the outer circumferential surface of the thin tube portion 46 as the thin tube portion 46 expands in the radial direction. Consequently, the gripping portion 92 of the adjacent conductor 78 increases in radius as shown in FIG. 6B. In other words, the gripping portion 92 of the adjacent conductor 78 is elastically deformed and increases in radius, allowing the thin tube portion 46 to expand due to heat. Thus, the fastening (compressive) stress on the thin tube portion 46 caused by the adjacent conductor 78 during the lighting is low. This prevents the occurrence of cracks or the like in the thin tube portion 46.

4. Example

The following describes an example of the lamp according to the Embodiment.

In this example of the lamp 14, power consumption is 70 W, and the total length of the lamp 14 is approximately 90 mm to 120 mm (the length changing slightly in accordance with the base 36 and the like that are used).

The main tube portion 44 of the arc tube 30 has an outer diameter of 9.7 mm and a thickness of 0.6 mm. The thin tube portions 46 and 48 have an outer diameter of 2.63 mm and a thickness of 0.9 mm.

The main tube portion 44 and the thin tube portions 46 and 48 are formed from polycrystalline alumina ceramic.

The envelope 50 is obtained by connecting two components, each component being an integral piece formed from half of the main tube portion 44 and one of the thin tube portions 46 and 48. For example, alumina in paste form is applied to the halves of the main tube portion 44 that face each other and sintered to integrally join the two components.

The electrode coils 60 and 62 in the electrodes 52 and 54 are molybdenum wires and have an outer coil diameter of 0.70 mm. The electrode bars 56 and 58 are made from tungsten and have a diameter of 0.35 mm.

The distance between the electrode coils 60 and 62 and the molybdenum coils 64 and 66 in the lamp axis direction (the length L1 shown in FIG. 9) is 2.45 mm. The distance in the lamp axis direction (the length L2 shown in FIG. 9) between the edges of the molybdenum coils 64 and 66, which are the nearer edges to the electrode coils 60 and 62, and the tips of the thin tube portions 46 and 48 (the ends opposite the main tube portion 44) is 12.75 mm.

A thin plate of molybdenum with a thickness of 0.1 mm is used as the adjacent conductor 78. The width of the adjacent conductor 78 (the dimension in the shorter direction of the metal plate) is 3.0 mm, and the length (the dimension in the longer direction of the metal plate) is 4.2 mm.

The gripping portion 92 is disposed on the thin tube portion 46 in the range of 265° around the tube axis (such an angle is referred to as "circular are angle", which is designated as B1 in FIG. 6A), and the area on the gripping portion 92 in this range is in contact with the outer circumferential surface of the thin tube portion 46. The distance in the lamp axis direction (the length L3 shown in FIG. 9) between the end of the adjacent conductor 78 in the width direction, which is the nearer end to the main tube portion 44, and the end of the molybdenum coil 64, which is the nearer end to the electrode coil 60 is 0.6 mm.

A molybdenum wire having a diameter of 0.6 mm is used for the power supply line 38. The distance (the length L4 shown in FIG. 4) between the tube axis of the thin tube portion 46 and the power supply line 38 is 3.0 mm.

The inner tube 32 has an outer diameter of 15.5 mm and a thickness of 1.25 mm and is made from fused quartz glass. The outer tube 34 has an outer diameter of 20.5 mm and a thickness of 1.3 mm and is made from hard glass.

The base 36 is a Swan base.

5. Adjacent Conductor (1) Thickness and Opening (Circular Arc Angle) of Adjacent Conductor FIG. 7 is a table showing the results of experiment testing the degree of ease of attaching the thin tube portion into a gripping portion of the adjacent conductor and the degree of contact between the adjacent conductor and the thin tube portion, with the thickness of the adjacent conductor and the circular arc angle B1 changed.

Figures 7, 8:
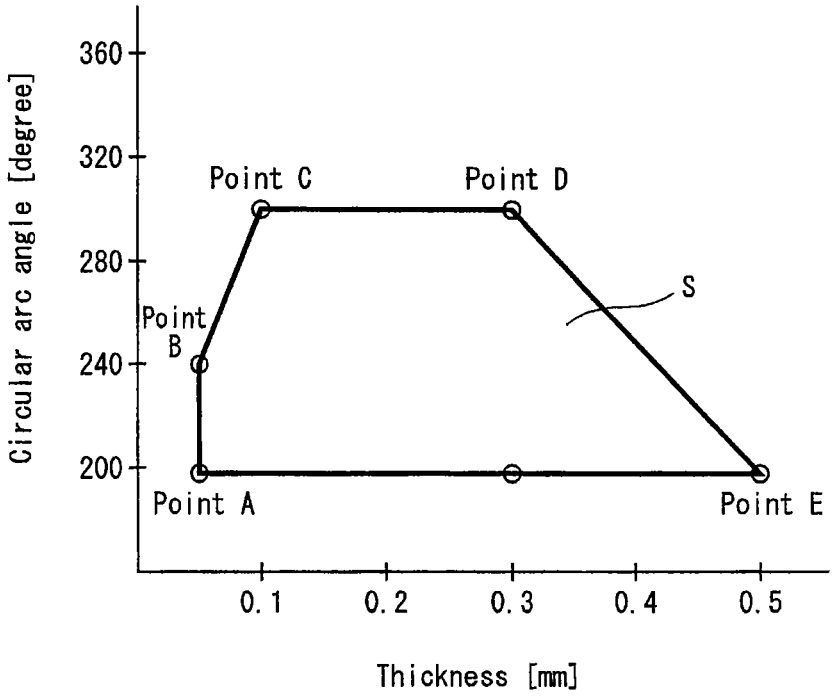
FIG. 7 is a table showing the results of experiment testing the degree of ease of attaching the thin tube portion into a gripping portion of the adjacent conductor and the degree of contact between the adjacent conductor and the thin tube portion, with the thickness of the adjacent conductor and the circular arc angle B1 changed.
FIG. 8 is a graph showing the results in FIG. 7, with the thickness and the angle on the x and y axes of the graph.

In FIG. 7, the circular arc angle B1 is set to be no less than 190°. This is because, when the circular arc angle B1 is less than 190°, the gripping portion 92 can not hold the thin tube portion 46, and the contact area between the gripping portion 92 and the thin tube portion 46 can not be stably maintained, which leads to unstable starting performance The ease of attachment greatly depends on the thickness of the adjacent conductor 78. When the thickness is 0.05 mm, the thin tube portion 46 can be fitted to the gripping portion 92 whenever the circular arc angle B1 is in the range from 190° to 360°. When the thickness is 0.5 mm, however, the thin tube portion 46 can be fitted to the gripping portion 92 only when the circular arc angle B1 is 190°. As described above, the ease of attaching the thin tube portion 46 to the gripping portion 92 decreases as the thickness of the metal plate forming the adjacent conductor 78 increases.

When the thickness is 0.1 mm and 0.3 mm, the degree of contact between the thin tube portion 46 and the gripping portion 92 is preferable when the circular arc angle B1 is in the range from 190° to 300°. When the thickness is 0.05 mm, which is thinner than 0.1 mm, the degree of contact is preferable when the circular arc angle B1 is in the range from 190° to 240°. When the thickness is 0.5 mm, which is thicker than 0.3 mm, the degree of contact is preferable only when the circular arc angle B1 is 190°.

FIG. 8 is an xy coordinate system showing the results in FIG. 7, with the thickness and the circular arc angle B1 on the x and y axes of the graph.

Taking into consideration the operability (workability) and the degree of contact of the adjacent conductor 78, it is preferable that the thickness and the circular arc angle B1, represented by (x,y), are within the area S shown in the drawing. Specifically, the area S is formed by connecting the points A (0.05,190), B(0.05,240), C(0.1,300), D(0.3,300) and E(0.5, 190) in this order, where x denotes the thickness and y denotes the circular arc angle B1.

It is particularly preferable that the thickness is in the range from 0.1 mm to 0.3 mm. If this is the case, it is possible to achieve high operability (workability). Also, it is preferable that the circular arc angle B1 is in the range from 190° to 300°. If this is the case, it is possible to achieve more stable starting performance.

(2) Position

Figure 9:
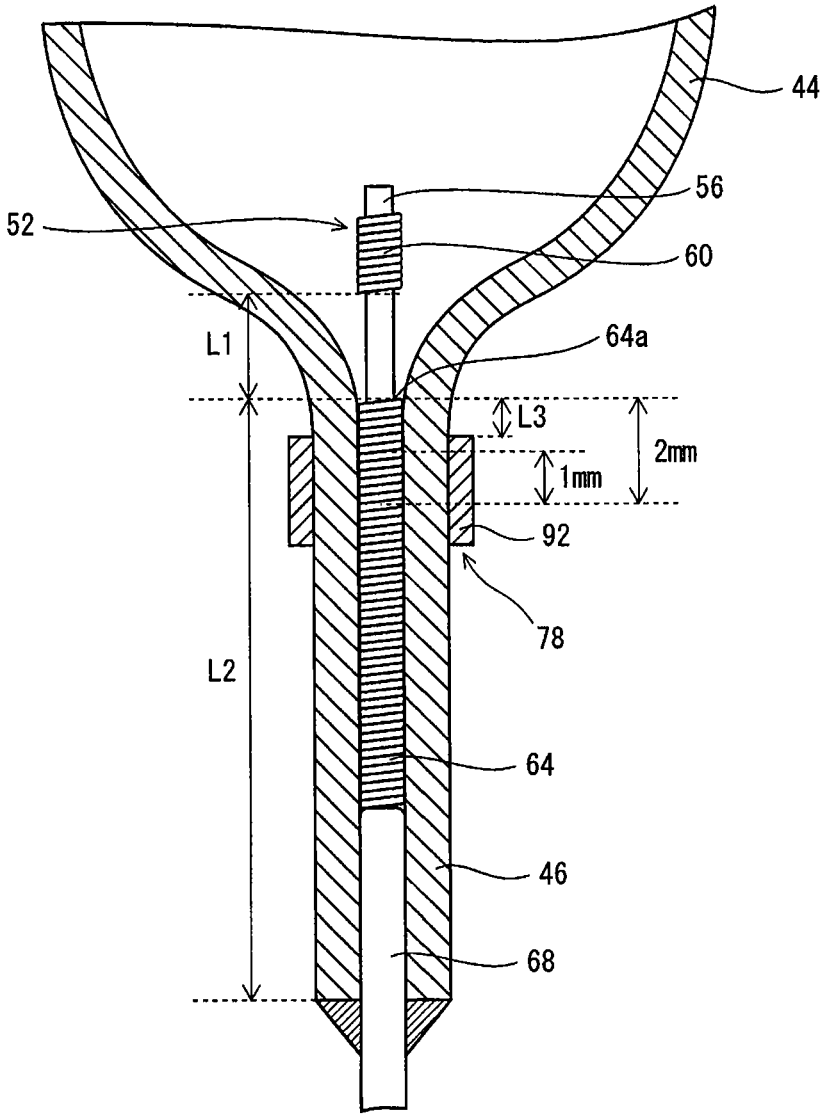
FIG. 9 illustrates a location of the adjacent conductor.

FIG. 9 illustrates a location of the adjacent conductor.

The adjacent conductor 78 is fixed to the power supply line (38) so as to be in contact with the portion of the outer circumferential surface of the thin tube portion 46, the portion being close to the main tube portion 44. Note that FIG. 9 illustrates as if there is no gap between the molybdenum coil 64 and the thin tube portion 46. In reality, however, there is a gap between the molybdenum coil 64 and the thin tube portion 46.

Regarding the adjacent conductor 78, it is preferable that the gripping portion 92 overlaps by 1 mm in the tube axis direction of the thin tube portion 46, with an area that is between the tip 64*a* as a reference point (the tip closer to the electrode coil 60) of the molybdenum coil 64 within thin tube portion 46 and a point that is 2 mm away from the reference point toward the power supplier 68.

FIG. 10 shows variations of the starting performance in relation to combinations of the location and width of the adjacent conductor.

L3 in this drawing indicates the same as L3 in FIG. 9. When L3 is a negative, it means that the closer end of the adjacent conductor 78 to the electrode 52 is closer to the electrode 52 than the tip 64*a* of the molybdenum coil 64 is. Note that the "Width" in the drawing is the dimension in the shorter direction of the strip-shaped metal plate, and corresponds to the dimension in the vertical direction in FIG. 9.

The sign ○ represents that the electrical breakdown occurred within five seconds from the startup, and smooth transition to the main discharge was exhibited. The sign Δ represents that the electrical breakdown occurred within five seconds from the startup, but the transition to the main discharge was not smooth. The sign x represents that it took more than five seconds before the electrical breakdown occurred.

In FIG. 10, when the width of the adjacent conductor 78 is 1 mm, the lamp exhibits a preferable starting performance represented as "○" when L3 is "0" and "1". In this case, the adjacent conductor 78 overlaps by 1 mm with an area that is between the tip 64*a* of the molybdenum coil 64 as a reference point within thin tube portion 46 and a point that is 2 mm away from the reference point toward the power supplier 68.

Similarly, when the adjacent conductor 78 is 2 mm and 3 mm, the adjacent conductor 78 overlaps the area by at least 1 mm.

In contrast, when the adjacent conductor 78 does not overlap the above-described area, that is, when L3 is greater than 2 mm, the starting performance is "Δ" regardless of the width of the adjacent conductor 78. When the end of the adjacent conductor 78 that is further from the electrode 52 is closer to the electrode 52 than the tip 64*a* of the molybdenum coil 64 is (i.e. when the entire adjacent conductor 78 is closer to the electrode 52 than the tip 64*a* of the molybdenum coil 64 is), the starting performance is "x" regardless of the width of the adjacent conductor 78.

(3) Combinations of Width, Circular Arc Angle, Etc.

The section (1) above describes the thickness of the adjacent conductor 78 and the opening (circular arc angle), and the section (2) above describes the position. Additionally, combining the width of the adjacent conductor 78, the circular arc angle and the position produces the following effects. Note that the term "width" refers to the width of the metal plate.

When the circular arc angle is in the range from 190° to 300° and the width is no less than 1 mm, the adjacent conductor 78 serves as a supporter which supports the arc tube 30. This improves resistance against drop impact in transportation, for example.

Furthermore, when the circular arc angle is in the range described above, the width of the adjacent conductor 78 is in the range described above, and the position of the adjacent conductor 78, specifically, L3 in FIG. 9 is equal to or less than 2 mm, the adjacent conductor 78 produces an effect of keeping the heat in an area on the arc tube 30 where the adjacent conductor 78 is disposed. Although the iodide as the light luminescent material is prevented from entering into the thin tube portions 46 and 48 by the molybdenum coils 64 and 66, the adjacent conductor 78 further prevents it, if this is the case.

Note that preventing the iodide from entering into the thin tube portion 46 leads to improvement of the lamp efficiency, reduction of color variations, etc.

<Modifications>

The present invention has been described based on the above Embodiment, but the present invention is of course not limited to the specific example indicated in the Embodiment. For example, the following modifications are possible.

1. Adjacent Conductor (1) Shape and Structure

The above Embodiment only shows an example of shape (structure) of the adjacent conductor 78, and other shapes and structure may be adopted. The following describes other shapes and structures as Modifications.

Figure 11A:
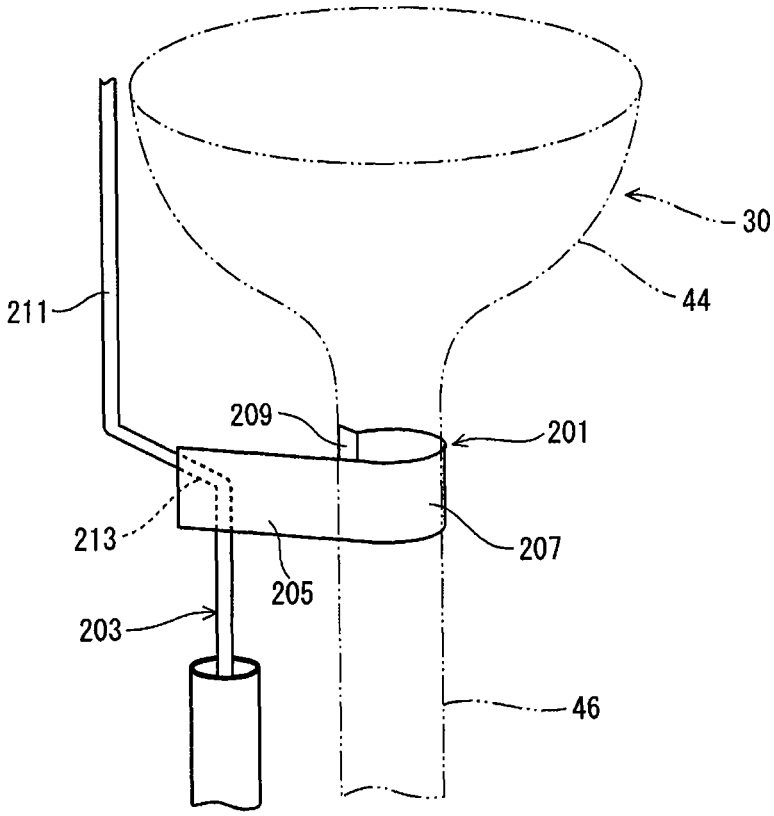
FIGS. 11A and 11B are schematic views showing an adjacent conductor according to Modification 1.
Figure 11B:
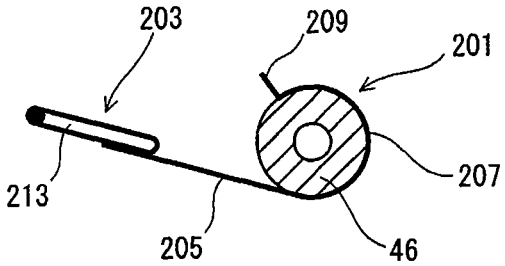

FIGS. 11A and 11B are schematic views showing an adjacent conductor according to Modification 1.

As shown in the drawings, an adjacent conductor 201 according to Modification 1 has a fixed portion 205, a gripping portion 207 and an angled portion 209. The fixed portion 205 is fixed to a power supply line 203. The gripping portion 207 is disposed along the outer circumferential surface of the thin tube portion 46. The angled portion 209 is angled outward from the end of the gripping portion 207 that is opposite the fixed portion 205 (this end is hereinafter referred to as "the distal end of the gripping portion 207").

The gripping portion 207 is curved along the outer circumferential surface of the thin tube portion 46, and has the same shape as the Embodiment, namely a C-shape, when viewed in the tube axis direction of the thin tube portion 46 (as shown in FIG. 11B).

The angled portion 209 also serves as a handle in the process of attaching the thin tube portion 46 into the C-shaped gripping portion 207, and further has a function of guiding the thin tube portion 46 into the gripping portion 207.

In the Embodiment, the fixed portion 90 is angled with respect to the gripping portion 92. The Modification 1 is different from the Embodiment only in that the fixed portion 205 extends straight from the proximal end of the gripping portion 207 toward the power supply line 203. That is, the fixed portion 205 extends in the direction of the tangent line at the proximal end of the gripping portion 207.

The power supply line 203 has a protruding section 211 that corresponds in location to the main tube portion 44 and protrudes outward in the direction that the fixed portion 205 extends. The fixed portion 205 is fixed (welded) to the power supply line 203 so as to cover the angled section 213 for forming the protruding section 211.

Figure 12A:
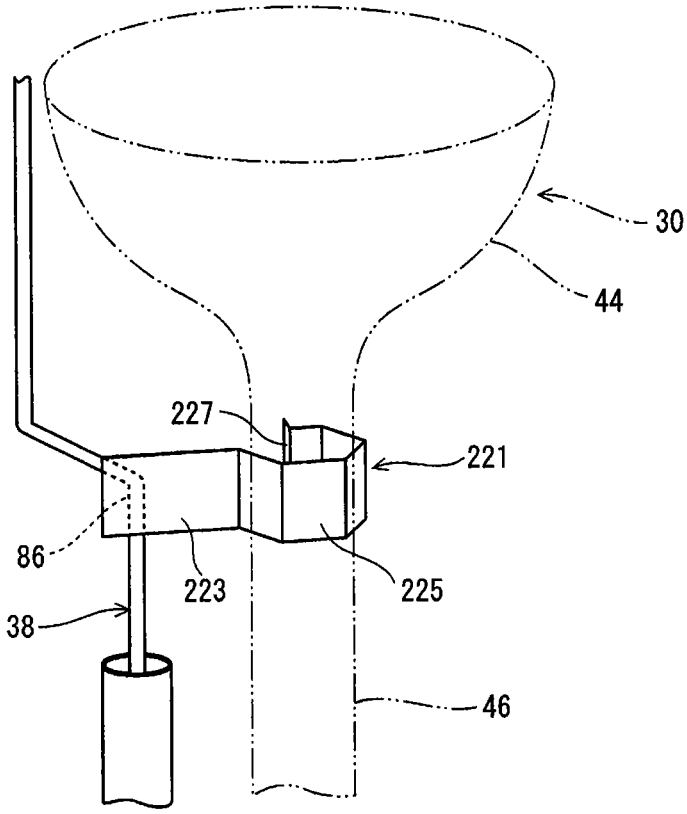
FIGS. 12A and 12B are schematic views showing an adjacent conductor according to Modification 2.
Figure 12B:
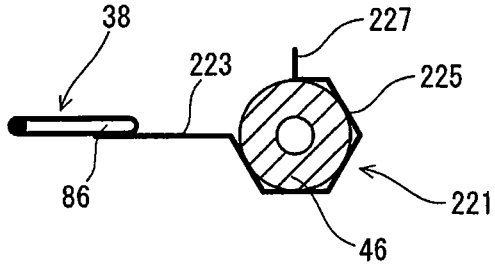

FIGS. 12A and 12B are schematic views showing an adjacent conductor according to Modification 2.

As shown in the drawings, an adjacent conductor 221 according to Modification 2 has a fixed portion 223, a gripping portion 225 and an angled portion 227. The fixed portion 223 is fixed to a power supply line 38. The gripping portion 225 is disposed along the outer circumferential surface of the thin tube portion 46. The angled portion 227 is angled outward from the end of the gripping portion 225 that is opposite the fixed portion 223 (this end is hereinafter referred to as "the distal end of the gripping portion 225").

The gripping portion 225 is angled at predetermined points along the outer circumferential surface of the thin tube portion 46, and has a C-shape (a hexagonal shape with a partial cutout) when viewed in the tube axis direction of the thin tube portion 46 (as shown in FIG. 12B), which is similar to the Embodiment. In the Modification 2, a surface of the adjacent conductor 221 corresponding to a side of the hexagon in the cross-sectional view is in contact with the outer circumferential surface of the thin tube portion 46.

The angled portion 227 also serves as a handle in the process of attaching the thin tube portion 46 into the C-shaped gripping portion 225, and further has a function of guiding the thin tube portion 46 into the gripping portion 225.

Figure 13A:
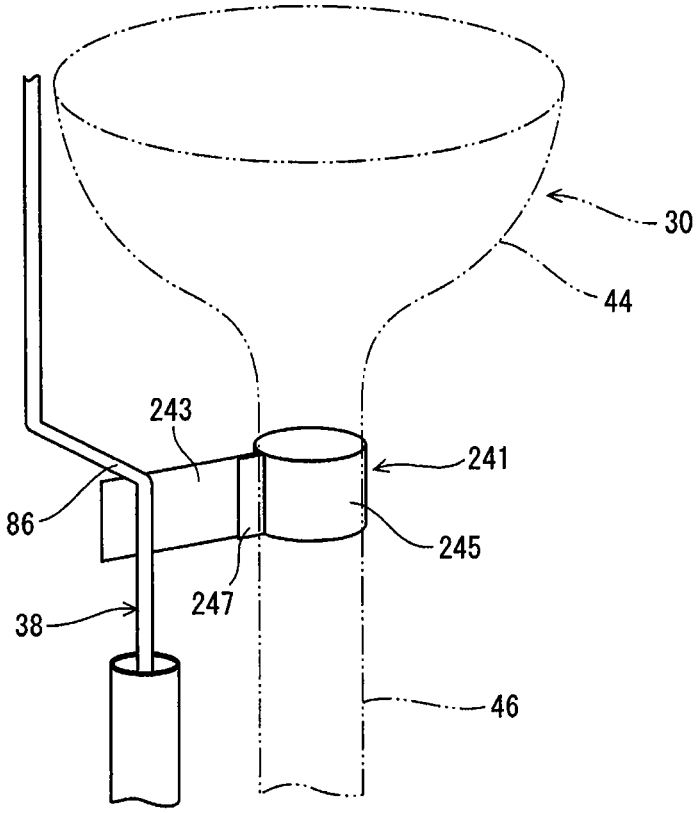
FIGS. 13A-13C are schematic views showing an adjacent conductor according to Modification 3.
Figure 13B:
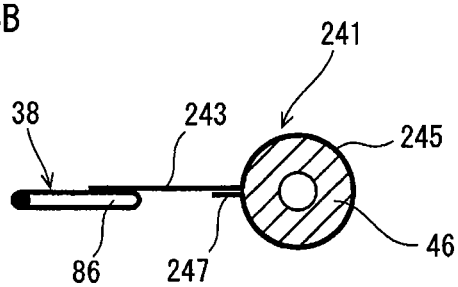
Figure 13C:
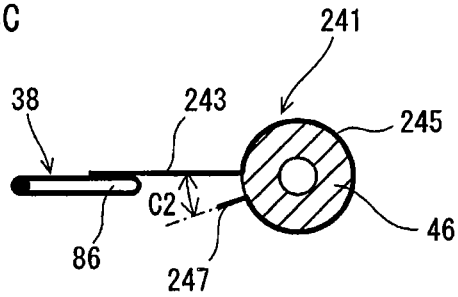

The fixed portion 223 is angled with respect to the gripping portion 225 as with the Embodiment. However, the fixed portion 223 may extend straight from the proximal end of the gripping portion 207, as with Modification 1, FIGS. 13A-13C are schematic views showing an adjacent conductor according to Modification 3. FIGS. 13A and 13B show the state before the lighting, and FIG. 13C shows the state during the lighting.

As shown in the drawings, an adjacent conductor 241 according to Modification 3 has a fixed portion 243, a gripping portion 245 and an angled portion 247. The fixed portion 243 is fixed to a power supply line 38. The gripping portion 245 is disposed along the outer circumferential surface of the thin tube portion 46. The angled portion 247 is angled outward from the end of the gripping portion 245 that is opposite the fixed portion 243 (this end is hereinafter referred to as "the distal end of the gripping portion 245").

The gripping portion 245 is disposed along the entire outer circumferential surface of the thin tube portion 46. The distal end of the gripping portion 245 and the angled portion 247 are substantially in contact with the proximal end of the gripping portion 245 (or the fixed portion 243). As shown in FIG. 13B, the gripping portion 245 roughly has an annular shape when viewed in the tube axis direction of the thin tube portion 46.

Note that the distal end of the gripping portion 245 is a free end, and is in contact with the proximal end of the gripping portion 245 (or the fixed portion 243) but is not fixed.

As shown in FIG. 13C, while the lamp is being lit, the gripping portion 245 increases in radius as the tube portion 46 expands in the radial direction, and the angled portion 247 moves away from the proximal end of the gripping portion 245 (or the fixed portion 243) by an angle C2 around the tube axis direction of the thin tube portion 46.

Figure 14A:
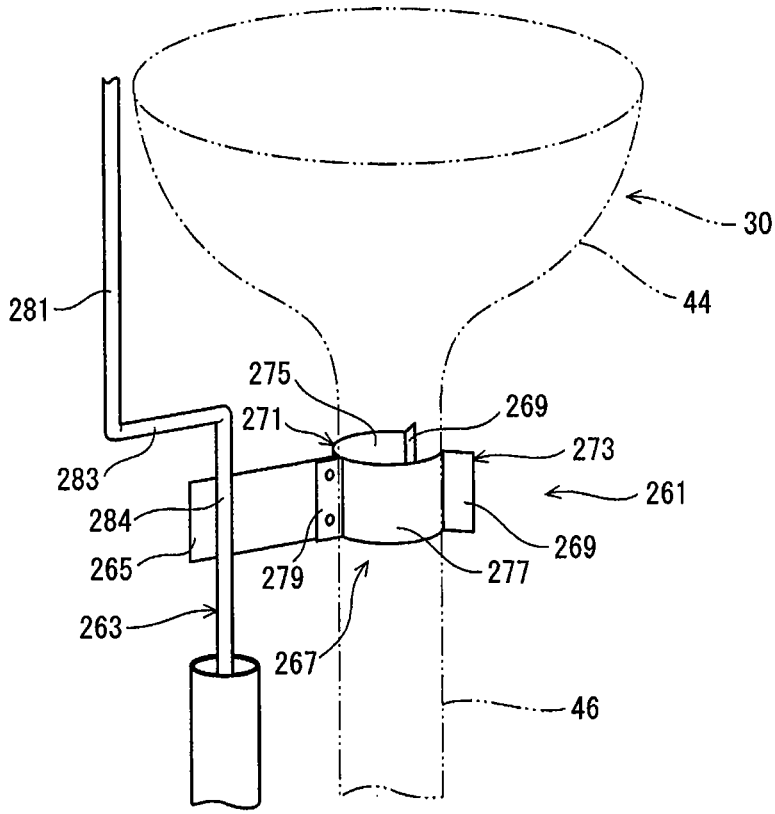
FIGS. 14A and 14B are schematic views showing an adjacent conductor according to Modification 4.
Figure 14B:
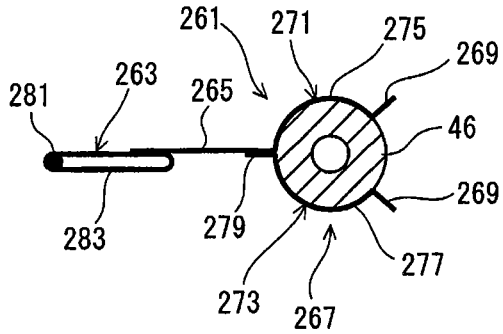

The fixed portion 243 is angled with respect to the gripping portion 245 as with the Embodiment. However, the fixed portion 243 may extend straight from the proximal end of the gripping portion 207, as with Modification 1, FIGS. 14A and 14B are schematic views showing an adjacent conductor according to Modification 4.

As shown in the drawings, an adjacent conductor 261 according to Modification 4 has a fixed portion 265, a gripping portion 267 and an angled portion 269. The fixed portion 265 is fixed to a power supply line 263. The gripping portion 267 is disposed along the outer circumferential surface of the thin tube portion 46. The angled portion 269 is angled outward from the end of the gripping portion 267 that is opposite the fixed portion 265 (this end is hereinafter referred to as "the distal end of the gripping portion 267").

In Embodiment and Modifications 1-3, each of the adjacent conductors 78, 201, 221 and 241 is made from a single metal plate. In Modification 4, however, the adjacent conductor is made from two strip-shaped metal plates 271 and 273. In other words, one metal plate 271 has a gripping portion 275, and a fixed portion 265 and an angled portion 269 located at either side of the gripping portion 275. The other metal plate 273 has a gripping portion 277, and an attaching portion 279 and an angled portion 269 located at either side of the gripping portion 277.

The attaching portion 279 of the other metal plate 273 is connected to the fixed portion 265 of the metal plate 271, by welding for example. Thus, the circular are angle (corresponding to B1 in FIG. 6A) of the adjacent conductor 261 in contact with the outer circumferential surface of the thin tube portion 46 is the total of the circular arc angle of the gripping portion 275 of the metal plate 271 in contact with the outer circumferential surface and the circular arc angle of the gripping portion 277 of the other metal plate 273 in contact with the outer circumferential surface.

Note that the portion of the power supply line 263 to which the fixed portion 265 is fixed is a straight section 284. The straight section 284 is located just before an angled section 283 which forms a protruding section 281 (i.e. located closer to the sealed portion 82) as shown in FIG. 14A.

The gripping portion 267 is curved along the outer circumferential surface of the thin tube portion 46, and has a C-shape when viewed in the tube axis direction of the thin tube portion 46 (as shown in FIG. 114B) as with the Embodiment.

The angled portions 269 also serve as a grip in the process of attaching the thin tube portion 46 into the C-shaped gripping portion 267, and further have a function of guiding the thin tube portion 46 into the gripping portion 267.

Although two metal plates 271 and 273 are used in Modification 4, three metal plates may be used. Specifically, a first metal plate having a straight shape in plan view and first and second metal plates each having a gripping portion and a attaching portion may be used, and the attaching portions of the first and second metal plates may be connected to the first metal plate.

Figure 15:
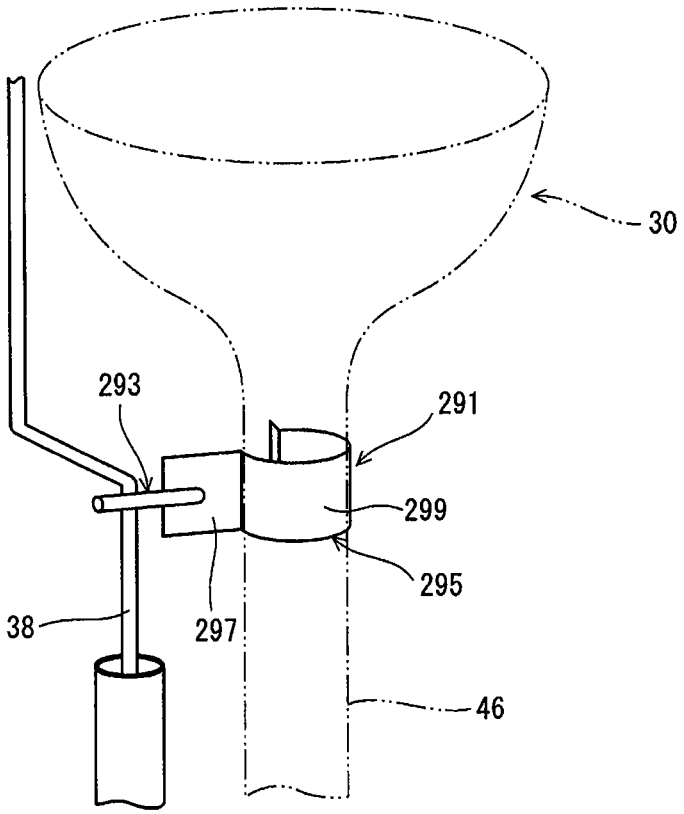
FIG. 15 is a schematic view showing an adjacent conductor according to Modification 5.

FIG. 15 is a schematic view showing an adjacent conductor according to Modification 5.

As shown in the drawing, an adjacent conductor 291 according to Modification 5 includes a fixed member 293 and a gripping member 295. The fixed member 293 is fixed to the power supply line 38. The gripping member 295 is disposed along the outer circumferential surface of the thin tube portion 46 so as to be in contact with the outer circumferential surface, thus gripping the thin tube portion 46.

The gripping member 295 is made from a metal plate, and includes a fixed portion 297 and a gripping portion 299. The fixed portion 297 is fixed to the fixed member 293 which is rod-shaped. The gripping portion 299 grips the thin tube portion 46. The proximal end of the fixed member 293 is fixed to the power supply line 38, and the distal end of the fixed member 293 is fixed to the fixed portion 297. As described above, the adjacent conductor 291 may have a member other than metal plates.

Although the gripping member 295 described above includes the fixed portion 297 and the gripping portion 299, the fixed portion may be included in the gripping portion. That is, the gripping portion of the gripping member may be directly connected to the distal end of the fixed member.

(2) Material

Although the adjacent conductor in the Embodiment is made of molybdenum, another material may be used as long as it is conductive. For example, niobium, tungsten, etc. may be used.

(3) Fixing Method

In Embodiment and so on, the fixed portion 90 of the adjacent conductor 78 for example is welded to the angled section 86 of the power supply line 38. However, as with the adjacent conductor 261 according to Modifications 4 (see FIGS. 14A and 14B), the fixed portion 265 may be welded to the straight section 284 of the power supply line 263.

In the case where the width (i.e. the dimension in the shorter direction, which is parallel to the lamp axis) of the adjacent conductor is the same, when the adjacent conductor is fixed to the angled section of the power supply line, the contact area between the adjacent conductor and the power supply line is larger than when fixed to the straight section. This leads to a stable fixing force. Also, when the adjacent conductor is fixed to the angled section, the adjacent conductor is further prevented from being twisted around the power supply line than when the adjacent conductor is fixed to the straight section.

The power supply line is disposed along the arc tube, and the section that corresponds in location to the main tube portion protrudes outward. It is preferable that the adjacent conductor is attached just before the protruding section (84) of the power supply line (i.e. located closer to the base). The term "just before the protruding section (84)" includes the angled section (86) or a curved section for forming the protrusion, and further includes the straight section closer to the base (36) than the angled section (86) and the curved section are. That is, when the adjacent conductor is attached to the power supply line, a section of the adjacent conductor protrudes further toward the inner tube than the power supply line, and the protruding section of the adjacent conductor is not to protrude further than the protruding section (84) of the power supply line (i.e. the protruding section of the adjacent conductor is to be located on the same surface as the protruding section or to be closer to the thin tube portion).

In the case where the adjacent conductor is made from a single metal plate, when the adjacent conductor is attached to the power supply line in the manner described above, the other end protrudes further outward (toward the inner tube) than the section of the power supply line to which the adjacent conductor is fixed. Since the other end is closer to the thin tube portion than the protruding section of the power supply line, the other end of the metal plate fixed to the power supply line is prevented from contacting the inner tube, and the adjacent conductor is prevented from contacting the inner tube when inserting the arc tube and so on into the inner tube. Thus, this structure makes the insertion of the arc tube and so on into the inner tube easy.

2. Arc Tube

The envelope 50 forming the arc tube 30 of the Embodiment is a piece integrating two components, each component being an integral piece formed from half of the main tube portion 44 and one of the thin tube portions 46 and 48, but the envelope according to the present invention is not limited to the envelope 50 of the Embodiment.

For example, the envelope may be integrated by shrink fitting after separately forming the main tube portion and the thin tube portions. Alternatively, the main tube portion and the thin tube portions need not be formed separately, but may be a single structure.

The envelope may also be formed from a tube (specifically, a cylinder), rings that are integrated with the cylinder respectively at either end by shrink fitting, and thin tube members, an end of each of which is shrink fitted into a through-hole in the center of a corresponding ring. In this case, the envelope is cylindrical.

3 Inner Tube and Outer Tube

In the Embodiment, the lamp has a triple tube structure with an arc tube, an inner tube, and an outer tube, but the lamp may have a double tube structure having an arc tube and an outer tube.

Furthermore, the inner tube in the Embodiment is sealed at the other end, but the inner tube may be sealed at both ends.

4. Base

In the Embodiment, as shown in FIG. 2, a pin-type base is used for the base 36, but another type of base may be used. For example, an E type (E26, EU10, etc.) screw base, which has a threaded shell section and an eyelet section, a G type base, and a PG type base may be used.

5. Lamp

In the Embodiment, the power consumption is 70 W, but the present invention is not limited to this figure. The present invention may be embodied with a power consumption in a range from 20 W to 150 W.

In the Embodiment, a metal halide lamp is used as an example for explanation, but the present invention may be applied to other lamps. For example, a high-pressure mercury-vapor lamp may be used.

INDUSTRIAL APPLICABILITY

The present invention is applicable to high-intensity discharge lamps having an arc tube and an adjacent conductor.

REFERENCE SIGNS LIST

30 Arc Tube
32 Inner Tube

34 Outer Tube
36 Base
38 Power Supply Line
44 Main tube portion
46, 48 Thin Tube Portion
78 Adjacent Conductor
90 Fixed Portion
92 Gripping Portion

The invention claimed is:

1. A high-intensity discharge lamp comprising:
an arc tube including a main tube portion and a pair of thin tube portions provided at ends of the main tube portion, the arc tube having a pair of electrodes;
at least one power supply line;
a container housing the arc tube; and
an adjacent conductor disposed within the container and aiding the arc tube to start discharge, wherein
the adjacent conductor includes a strip-shaped metal plate,
at least one end portion of the metal plate is a gripping portion for gripping one of the thin tube portions, the gripping portion being curved along an outer circumferential surface of the one of the thin tube portions so as to be in contact with the outer circumferential surface, and
one end of the metal plate is a free end that includes a fixing portion for attachment to the power supply line, and the gripping portion is elastically deformable in accordance with thermal expansion of the one of the thin tube portions, wherein the gripping portion and the fixing portion are aligned along a perpendicular direction to a tube axis extending through the pair of thin tube portions and the pair of electrodes.

2. The high-intensity discharge lamp of claim 1, wherein
the one end of the metal plate is angled or curved outward in a radial direction of the one of the thin tube portions.

3. The high-intensity discharge lamp of claim 2, wherein
the electrodes are held by the thin tube portions such that tips of the electrodes are located within the main tube portion,
the arc tube is supported by a pair of power supply lines that supply the electrodes with power, and
the other end of the metal plate of the adjacent conductor is fixed by the fixing portion to one of the power supply lines that supplies one of the electrodes held by the other one of the thin tube portions.

4. The high-intensity discharge lamp of claim 1, wherein
the electrodes are held by the thin tube portions such that tips of the electrodes are located within the main tube portion,
the are tube is supported by a pair of power supply lines that supply the electrodes with power, and
the other end of the metal plate of the adjacent conductor is fixed by the fixing portion to one of the power supply lines that supplies one of the electrodes held by the other one of the thin tube portions.

5. The high-intensity discharge lamp of claim 4, wherein
the one of the power supply lines is provided adjacent the tube axis direction of the arc tube, and a section thereof is angled or curved outward in a direction perpendicular to the tube axis direction so as to form a protrusion, the protrusion corresponding in location to the main tube portion, and
the other end of the metal plate of the adjacent conductor is fixed by the fixing portion to at least to the section.

6. The high-intensity discharge lamp of claim 5, wherein
each of the electrodes includes an electrode bar, around which a molybdenum coil is wrapped, and the electrodes are inserted in the thin tube portions respectively, and
the gripping portion of the adjacent conductor overlaps by at least 1 mm in the tube axis direction with an area that is between (i) one tip of the molybdenum coil that is located within the one of the thin tube portions, the one tip being closer to the main tube than the other tip of the molybdenum coil is, and (ii) a point located 2 mm away from the one tip toward the other tip of the molybdenum coil.

7. The high-intensity discharge lamp of claim 1, wherein
the gripping portion wraps around no less than 190° nor more than 300° of the one of the thin tube portions with respect to the tube axis of the one of the thin tube portions.

8. The high-intensity discharge lamp of claim 1, wherein
a thickness of the metal plate is in a range from 0.1 mm to 0.3 mm.

9. The high-intensity discharge lamp of claim 1, wherein
each of the electrodes includes an electrode bar, around which a molybdenum coil is wrapped, and the electrodes are inserted in the thin tube portions respectively, and
the gripping portion of the adjacent conductor overlaps by at least 1 mm in the tube axis direction with an area that is between (i) one tip of the molybdenum coil that is located within the one of the thin tube portions, the one tip being closer to the main tube than the other tip of the molybdenum coil is, and (ii) a point located 2 mm away from the one tip toward the other tip of the molybdenum coil.

10. The high-intensity discharge lamp of claim 9, wherein
the gripping portion wraps around no less than 190° nor more than 300° of the one of the thin tube portions with respect to the tube axis of the one of the thin tube portions.

11. The high-intensity discharge lamp of claim 10, wherein
a thickness of the metal plate is in a range from 0.1 mm to 0.3 mm.

12. The high-intensity discharge lamp of claim 1, wherein
the arc tube is supported by a pair of power supply lines that supply the pair of electrodes with power, and one of the power supply lines has a protruding section that extends outward along a side of the main tube portion with a curved portion connected to another portion of the power supply line adjacent one of the pair of thin tube portions, wherein
the fixing portion of the adjacent conductor is attached to the protruding section, adjacent a base of the arc tube, on the curved portion to provide positional support for maintaining a controlled distance between the arc tube and the power supply line, when the gripping portion is mounted on the one of the thin tube portions.

13. The high-intensity discharge lamp of claim 1 wherein
the strip-shaped metal plate has an elongated rectangular shape forming a planar fixing portion at the free end and extends within a single continuous plane to the other end portion which is configured into a bent configuration that extends about a circumference of one of the pair of thin tube portions to form the gripping portion.

14. The high-intensity discharge lamp of claim 13 wherein
the strip-shaped metal plate is molybdenum.

15. A high-intensity discharge lamp comprising:
an are tube including a main tube portion with luminescent material and a pair of thin tube portions provided at ends of the main tube portion, the arc tube having a pair of elongated electrodes;
a power supply line connected to each electrode;
each elongated electrode has molybdenum coils wrapped around the elongated electrodes that are positioned within each thin tube portion to prevent luminescent material from entering between the electrodes and an interior of the thin tube portion;

a container housing the arc tube; and an adjacent conductor disposed within the container and aiding the arc tube to start discharge, wherein the adjacent conductor consists of a strip-shaped metal plate having at least one end portion of the metal plate as a gripping portion for gripping one of the thin tube portions, the gripping portion being curved along an outer circumferential surface of the one of the thin tube portions so as to be in contact with the outer circumferential surface, and the other end of the metal plate is a free end offset from the one of the thin tube portions to provide a fixing portion for attachment to the power supply line, and the gripping portion is elastically deformable in accordance with thermal expansion of the one of the thin tube portions, wherein the gripping portion and the fixing portion are aligned along a perpendicular direction to a tube axis extending through the pair of thin tube portions and the pair of electrodes, the gripping portion is positioned on the one of the thin tube portions to extend over the molybdenum coils adjacent a transition portion of the thin tube to the main tube portion to maintain heat in the transition portion to further prevent luminescent material from entering the thin tube.

16. The high-intensity discharge lamp of claim 15 wherein the strip-shaped metal plate has an elongated rectangular shape forming a planar fixing portion at the free end and extends within a single continuous plane to the other end portion which is configured into a bent configuration that extends about a circumference of one of the pair of thin tube portions to form the gripping portion.

17. The high-intensity discharge lamp of claim 15 wherein the one end of the metal plate is angled or curved outward in a radial direction of the one of the thin tube portions to form the fixing portion that is integrally connected to the power supply line by welding along the angled or curved end to provide a stable fixing location offset from the one of the thin tube portions.

18. The high-intensity discharge lamp of claim 15 wherein the gripping portion wraps around no less than 190° nor more than 300° of the one of the thin tube portions with respect to a tube axis of the one of the thin tube portions.

19. The high-intensity discharge lamp of claim 15 wherein the thickness of the metal plate is between 0.1 mm and 0.3 mm.

20. The high-intensity discharge lamp of claim 19 wherein the length of the metal plate is approximately 4.2 mm and the width is approximately 3.0 mm.

* * * * *